US008836302B2

(12) United States Patent
Chen

(10) Patent No.: US 8,836,302 B2
(45) Date of Patent: Sep. 16, 2014

(54) LOW DROPOUT VOLTAGE REGULATOR AND ELECTRONIC DEVICE THEREOF

(75) Inventor: Yi-Lung Chen, Keelung (TW)

(73) Assignee: ISSC Technologies Corp., Hsinchu (TW)

( * ) Notice: Subject to any disclaimer, the term of this patent is extended or adjusted under 35 U.S.C. 154(b) by 189 days.

(21) Appl. No.: 13/620,929

(22) Filed: Sep. 15, 2012

(65) Prior Publication Data

US 2014/0015502 A1 Jan. 16, 2014

(30) Foreign Application Priority Data

Jul. 13, 2012 (TW) ..... 101125343 A

(51) Int. Cl.
*G05F 1/56* (2006.01)

(52) U.S. Cl.
USPC ..... 323/274; 323/901

(58) Field of Classification Search
USPC ..... 323/273–280, 901, 908
See application file for complete search history.

(56) References Cited

U.S. PATENT DOCUMENTS

| | | | | |
|---|---|---|---|---|
| 7,038,514 | B2 * | 5/2006 | Leith et al. | 327/198 |
| 7,501,805 | B2 * | 3/2009 | Chen et al. | 323/282 |
| 7,541,795 | B1 * | 6/2009 | Smith et al. | 323/285 |
| 7,882,383 | B2 * | 2/2011 | May et al. | 713/500 |
| 8,575,903 | B2 * | 11/2013 | Hua et al. | 323/273 |

* cited by examiner

*Primary Examiner* — Jessica Han
(74) *Attorney, Agent, or Firm* — Li & Cai Intellectual Property (USA) Office

(57) ABSTRACT

A low dropout voltage regulator is provided. The low dropout voltage regulator includes a comparison unit, a buck unit, a feedback unit and a current-drawing unit. The comparison unit is used for receiving a reference voltage and a feedback voltage, and comparing the reference voltage and the feedback voltage to output a first voltage. The buck unit is used for receiving an input voltage and the first voltage and transferring the input voltage to a output voltage. The feedback unit is used for receiving the output voltage, and converting the output voltage to a feedback voltage, and then transmitting the feedback voltage to the comparison unit. The current-drawing unit determines whether to draw a portion of a first current generated by the buck unit, so as to stabilize the output voltage.

19 Claims, 6 Drawing Sheets

LOW DROPOUT VOLTAGE REGULATOR AND ELECTRONIC DEVICE THEREOF

BACKGROUND OF THE INVENTION

1. Field of the Invention

The present invention relates to a buck circuit; in particular, to draw leakage current of a low dropout voltage regulator timely.

2. Description of Related Art

Recently, because of characteristics of the enhancement for the conversion efficiency, small volume and low noise, the low dropout voltage regulator becomes a mainstream of buck circuit with low power and regulator circuit. In the wide range of the portable system and the electronic product related to the communication that the battery provide the power, the low dropout voltage regulator is widely used.

The low dropout voltage regulator may be adapted to multiple electronic equipment, such as notebook computer、cell phone、personal digital assistant but is not limited thereto, and the low dropout voltage regulator may provide stable output voltage for the load of the electronic equipment.

Referring to FIG. 1, FIG. 1 shows a circuit diagram of the conventional low dropout voltage regulator. The low dropout voltage regulator includes a comparator OP', P-type transistor MP' and the resistances R1、R2. The negative input end of the comparator OP' receives the feedback voltage VF' and the output end of the comparator OP' outputs the voltage V1'. A gate of the P-type transistor MP' receives the voltage V1', a source of the P-type transistor MP' receives the input voltage VIN', and a drain of the P-type transistor MP' output the output voltage VOUT'. One end of the resistance R1 is electrically connected to the source of the P-type transistor so as to receive the output voltage VOUT'. Another one end of the resistance R1 is electrically connected to one end of the resistance R2 so as to output the feedback voltage VF. Another one end of the resistance R2 is electrically connected to the ground voltage GND.

If the conventional low dropout voltage regulator 100 ideally works under normal operation, the low dropout voltage regulator 100 may provide stable output voltage VOUT' through the negative feedback mechanism within itself. More specifically, in normal operation situation, the output voltage VOUT' is determined by the reference voltage VREF'. When the negative feedback mechanism exists efficiently, the feedback voltage VF' is equal to the reference voltage VREF', i.e. VOUT'=(1+R1/R2)VREF'.

However, in non-ideal situation, when the input voltage VIN' is a voltage outside the normal operation range of the low dropout voltage regulator 100, or the low dropout voltage regulator 100 works in high temperature or in fast process corner, the P-type transistor MP' may generate a leakage current. Meanwhile, the current I1' is the leakage current. Next, when the leakage current flow through the resistances R1、R2, the feedback voltage VF' and the output voltage VOUT' may be further elevated. Accordingly, the negative feedback mechanism within the low dropout voltage regulator 100 is to be destroyed, and then the output voltage VOUT' may approach the input voltage VIN, and thus cause damage of the load which receives the output voltage VOUT'.

SUMMARY OF THE INVENTION

The present invention provides a low dropout voltage regulator and electronic device thereof, the low dropout voltage regulator is capable of providing stable output voltage.

In an embodiment of the present invention provides a low dropout voltage regulator, the low dropout voltage regulator includes a comparison unit, a buck unit, a feedback unit and a current-drawing unit. The comparison unit is used for receiving a reference voltage and a feedback voltage and outputting a first voltage and comparing the reference voltage and the feedback voltage to output a first voltage. The buck unit is electrically connected to the comparison unit and receiving an input voltage and the first voltage, and then having the input voltage stepping down to an output voltage, wherein the buck unit outputs a first current according to the first voltage and the output voltage. The feedback unit is electrically connected between the buck unit and the comparison unit and receiving the output voltage, and after converting the output voltage to the feedback voltage, the feedback unit transmits the feedback voltage to the comparison unit. The current-drawing unit is used for receiving the input voltage and output voltage. When the input voltage is smaller than a start-up voltage, the current-drawing unit turns off and a second current flowing through the feedback unit is equal to the first current. When the output voltage is larger than the start-up voltage, the current-drawing unit draws a third current and the third current is equal to a sum of the first current and the second current.

In an embodiment of the present invention provides an electronic device, the electronic device includes low dropout voltage regulator and a load. The low dropout voltage regulator is used for receiving an input voltage and having the input voltage stepping down to an output voltage. The load is used for receiving the output voltage.

In summary, the low dropout voltage regulator provided by the embodiments of the instant disclosure is capable of ensuring normal operation of a negative feedback mechanism in the low dropout voltage regulator, so as to stabilize a predetermined output voltage.

For further understanding of the present invention, reference is made to the following detailed description illustrating the embodiments and examples of the present invention. The description is only for illustrating the present invention, not for limiting the scope of the claim.

DETAILED DESCRIPTION OF PREFERRED EMBODIMENTS

Figure 1:
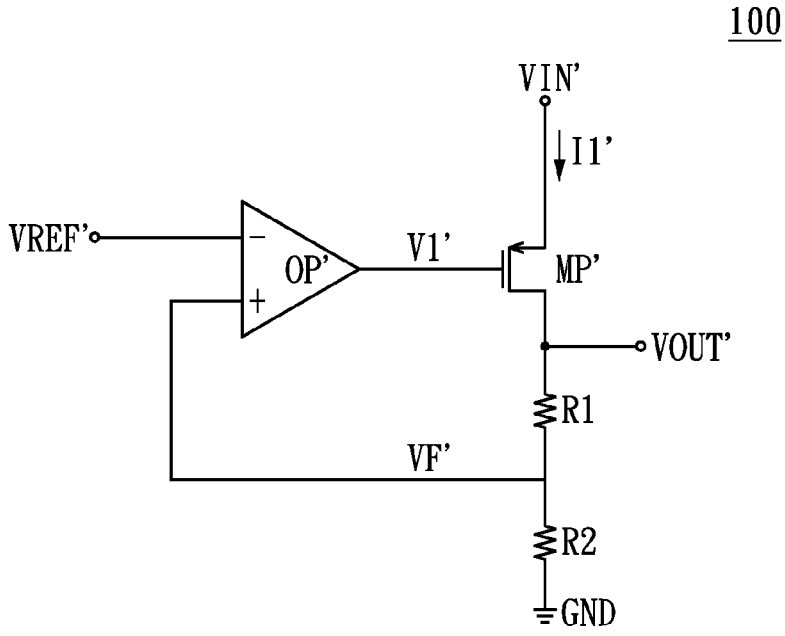
FIG. 1(PRIOR ART)
FIG. 1 shows a circuit diagram of the conventional low dropout voltage regulator.

The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the present disclosure. As used herein, the term "and/or" includes any and all combinations of one or more of the associated listed items.

[Embodiment of a Low Dropout Voltage Regulator]

Figure 2:
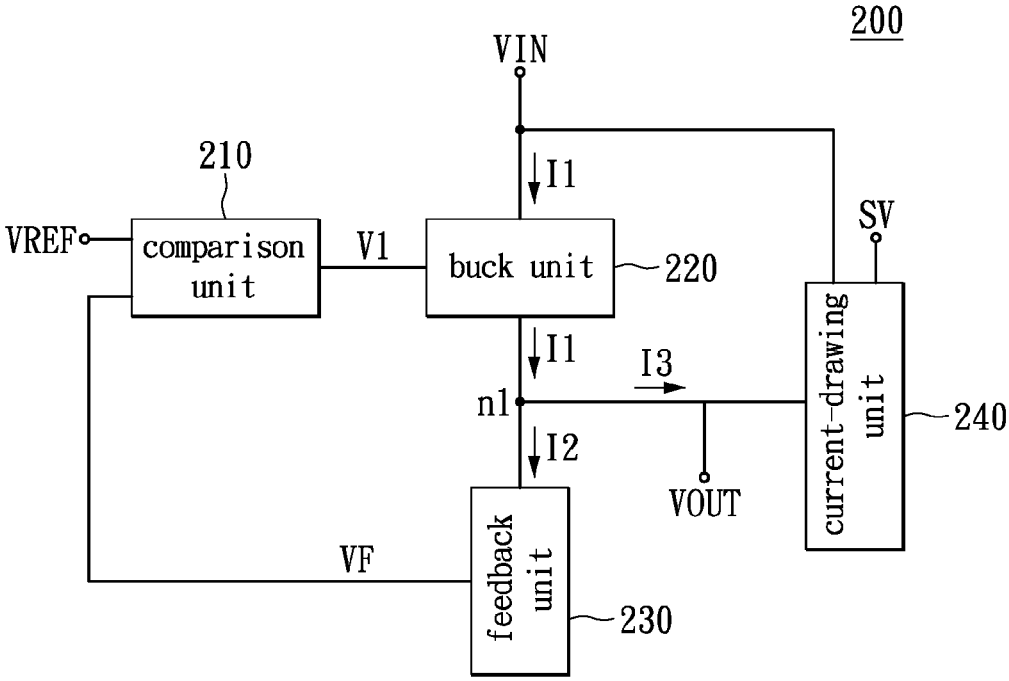
FIG. 2 shows a schematic diagram of a low dropout voltage regulator according to one embodiment of present disclosure.

Referring to FIG. 2, FIG. 2 shows a schematic diagram of a low dropout voltage regulator according to one embodiment of present disclosure. The low dropout voltage regulator 200 includes a comparison unit 210, a buck unit 220, a feedback unit 230 and a current-drawing unit 240. The buck unit 220 is electrically connected to a comparison unit 210. The feedback unit 230 is electrically connected between the buck unit 220 and the comparison unit 210.

In the embodiment, the comparison unit 210 is used for receiving a reference voltage VREF and a feedback voltage VF so as to output a first voltage V1, wherein a value of the reference voltage VREF may be set by a designer according to a demand of circuit design or real application.

The buck unit 220 is used for receiving a input voltage VIN and a first voltage V1 and having the input voltage VIN stepping down to a output voltage VOUT, wherein the buck unit 220 outputs a first current I1 according to value of the first voltage and the input voltage. Incidentally, the input voltage VIN may be a system voltage in the electronic device.

The feedback unit 230 is used for receiving the output voltage VOUT. After converting the output voltage VOUT to the feedback voltage VF by the feedback unit 230, the feedback voltage VF is transmitted to the comparison unit 210, so that the comparison unit 210 may proceed a comparison operation of both reference voltage VREF and the feedback voltage VF, wherein the feedback voltage VF is a partial voltage of the output voltage VOUT. Additionally, a second current I2 is determined by the reference voltage VREF and a plurality of resistances within the feedback unit 230.

The current-drawing unit 240 is used for receiving the input voltage VIN and the output voltage VOUT. When the input voltage VIN is smaller than a start-up voltage SV, the current-drawing unit 240 turns off and then the first current I1 is substantially equal to the second current I2. When the input voltage VIN is larger than the start-up voltage SV, the current-drawing unit 240 may draw a third current I3 of the first current I1. In other words, the first current I1 is equal to a sum of the second current I2 and the third current I3.

Under non-ideal situation, when the first current I1 generated from the buck circuit 220 increases, i.e. generating a leakage current and the leakage current might be larger than the first current I1 under normal situation, the current-drawing unit 240 may draw an amount of current increased by the first current I1 correspondingly. In other words, an amount of current increased by the third current I3 draw by the current-drawing unit 240 under non-ideal situation is an amount of current increased by the first current I1 under non-ideal situation. Therefore, the second current I2 flowing through the feedback unit 230 may still maintain a fix so as to stabilize the output voltage VOUT.

Before teaching embodiment of the present disclosure, it is to be explained that the start-up voltage SV is a threshold voltage to generate a current channel for the current-drawing unit 240 drawing the third current I3.

What follows is further to describe detailed operation of the low dropout voltage regulator 200.

Referring to FIG. 2 continuously, compared with conventional low dropout voltage regulator 100, low dropout voltage regulator 100 may generate undesired leakage current because the input voltage VIN' is too high or the low dropout voltage regulator 100 works in high temperature or in the fast process corner. The leakage current may destroy a negative feedback mechanism within the conventional low dropout voltage regulator 100, so that the output voltage VOUT' deviates a predetermined value. Therefore, the low dropout voltage regulator 200 provided by the present disclosure may timely generate a current channel to draw undesired leakage current. It is to be noted that a person skilled in the art should understand that high temperature indicates an operation temperature exceeds 50 degrees Celsius. Furthermore, when the operation temperature increases until a temperature the low dropout voltage regulator 200 begins to generate leakage current, the temperature should be understand as entering in the high temperature region for the operation temperature.

In the present embodiment, when the input voltage VIN, such as a system voltage in the electronic device, is a voltage within normal operation range or the low dropout voltage regulator 200 does not work in the high temperature region or in the fast process corner, the first current I1 generated from the low dropout voltage regulator 200 is equal to the second current I2, i.e. the leakage current dose not be generated. Furthermore, under the above-mentioned three situations, it may lead to that the input voltage VIN is smaller than the start-up voltage SV of the current-drawing unit 240 so that the low dropout voltage regulator 200 does not further generate the current channel to draw a portion of the leakage current, i.e. the third current I3. In short, if the leakage current does not generate, the current-drawing unit 240 may be closed and does not generate the current channel to draw the third current I3.

Additionally, under the above-mentioned three situations, after the comparison unit 210 receives the reference voltage VREF and feedback voltage VF, the comparison unit 210 may do operation for comparison. Next, the comparison unit 210 outputs the first voltage V1 and transmits the first voltage V1 to the buck unit 220 so as to start the buck unit 220 according to a result of operation for comparison. After the buck unit 220 receives the first voltage V1 transmitted by the comparison unit 210, the buck unit 220 may generate the first current I1. Next, the buck unit 220 may have the input voltage VIN stepping down to the output voltage VOUT, and transmit the output voltage VOUT to the feedback unit 230 and the current-drawing unit 240.

Meanwhile, because the input voltage VIN is not larger than the start-up voltage SV of the current-drawing unit 240, the current-drawing unit 240 does not generate the current channel to draw any current. Therefore, the relationship about the first current I1 being equal to the second current I2 may establish at node n1 and the second current I2 may flow into the feedback unit 230. Afterwards, when the feedback unit 230 receives the output voltage VOUT or the second current I2 outputted by the buck unit 220, the feedback unit 230 may convert the output voltage VOUT to the feedback voltage VF. In the embodiment, the feedback unit 230 makes the output voltage VOUT step down and converts the output voltage VOUT to the feedback voltage VF. Next, the feedback unit 230 transmits the feedback voltage VF to the comparison unit 210 so that the low dropout voltage regulator 200 may constantly stabilize the output voltage VOUT through the negative feedback mechanism, wherein the output voltage VOUT is determined by a plurality of resistance within the feedback unit 230 and the reference voltage VF.

In the other hand, when the input voltage VIN, such as the system voltage of the electronic device, is the voltage outside the normal operation range of the low dropout voltage regulator 200, i.e. the input voltage VIN is much larger than the predetermined output voltage VOUT, or the low dropout voltage regulator 200 works in the high temperature region or in the fast process corner, the low dropout voltage regulator 200 may generate the leakage current so that the first current I1 is larger than the first current I1 of the normal situation. Under the above-mentioned three situations, because the input voltage VIN is larger than the start-up voltage SV of the current-drawing unit 240, the low dropout voltage regulator 200 may start the current-drawing unit 240 so as to generate the current channel to draw a portion of the leakage current, i.e. the third current I3 is not equal to zero. In short, if the leakage current exists, the current-drawing unit 240 may be opened and generate the current channel to draw the third current I3 which is not equal to zero.

Therefore, under the above-mentioned three non-ideal situations, after the comparison unit 210 receives the reference voltage VREF and the feedback voltage VF, the comparison unit 210 may proceed a comparison operation of both reference voltage VREF and the feedback voltage VF. The comparison unit 210 may output the first voltage V1 and transmit the first voltage V1 to the buck unit 220 so as to turn-off the buck unit 220 according to a result of operation for comparison. However, because the buck unit 220 does not be closed totally under the non-ideal situation, the leakage current of the buck unit 220 is equal to amount of the current increased from the first current I1. Afterwards, the buck unit 220 makes the input voltage VIN step down to the output voltage VOUT, and then outputs the output voltage VOUT and transmits the output voltage VOUT to the feedback unit 230 and the current-drawing unit 240.

At this time, because the input voltage VIN is larger than the start-up voltage SV of the current-drawing unit 240, the current-drawing unit 240 may generate the current channel so as to draw the third current I3, wherein the first current I1 is equal to a sum of the second current I2 and the third current I3.

Next, after the feedback unit 230 receives the output voltage VOUT outputted by the buck unit 220, the second current I2 may flow through the feedback unit 230 and the feedback unit 230 may convert the output voltage VOUT to the feedback voltage VF. Afterwards, the feedback voltage VF is transmitted to the comparison unit 210 by the feedback unit 230 so that the low dropout voltage regulator 200 may constantly stabilize the output voltage VOUT through the negative feedback mechanism within low dropout voltage regulator 200. Accordingly, the low dropout voltage regulator 200 is able to draw the third current undesired according to the current channel generated by the current-drawing unit 240, so as to avoid destroying the original negative feedback mechanism due to addition of the first current I1 under the non-ideal situation. Therefore, the low dropout voltage regulator 200 may still stabilize the predetermined output voltage VOUT, wherein the output voltage VOUT is determined by a plurality of resistance within the feedback unit 230 and the reference voltage VF.

In short, without departing from the spirit of utilizing the current-drawing unit 240 to draw the third current I3 so as to stabilize the predetermined output voltage VOUT, the scope disclosed all belongs to the thoughts of technology of the present disclosure. It is worth mentioning that the current-drawing unit 240 is started synchronously when the first current I1 increases under the non-ideal situation.

What follows is further illustrating at least one embodiment of the embodiments for explaining the operation of the low dropout voltage regulator 200 in detail.

[Another One Embodiment of the Low Dropout Voltage Regulator]

Figure 3:
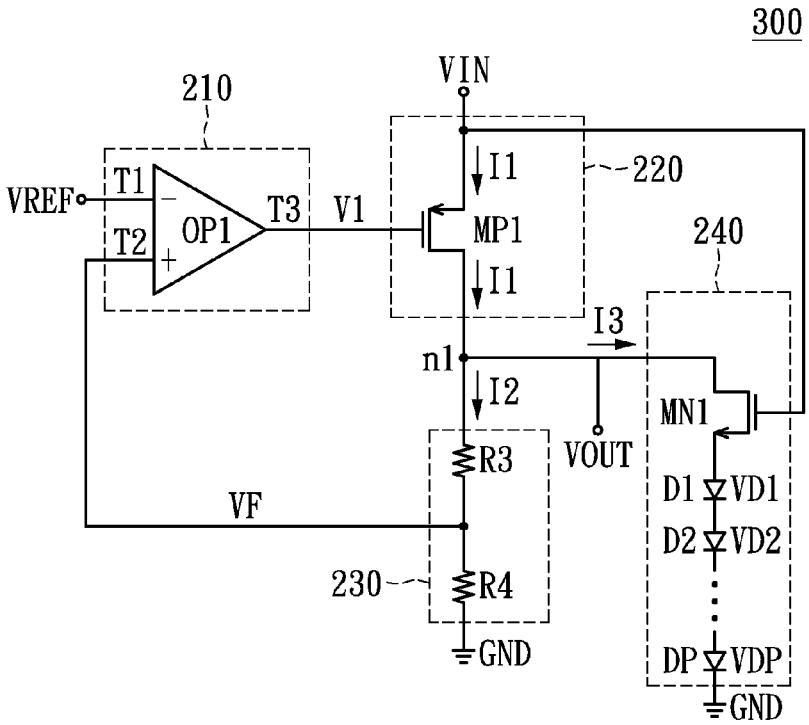
FIG. 3 shows a detailed circuit diagram of the low dropout voltage regulator according to another one embodiment of the instant disclosure.

Referring to FIG. 3, FIG. 3 shows a detailed circuit diagram of the low dropout voltage regulator according to another one embodiment of the instant disclosure. In this embodiment, the comparison unit 210 of the low dropout voltage regulator 300 is a first comparator OP1. The buck unit 220 includes P-type transistor MP1. The feedback unit 230 includes a third resistance R3 and a fourth resistance R4. The current-drawing unit 240 includes a first N-type transistor MN1 and P first diodes D1~Dp, wherein P is a positive integer.

A first positive input end T1 of the comparison unit 210 receives the feedback voltage VF, a first negative input end T2 of the comparison unit 210 receives the reference voltage VREF, and a first output end T3 of the comparison unit 210 outputs a first voltage V1. A gate of the P-type transistor MP1 is electrically connected to a first output end T3 of the comparison unit 210 so as to receive the first voltage V1, a source of the P-type transistor MP1 receives the first voltage V1, and a drain of the P-type transistor MP1 outputs the output voltage VOUT and the first current I1. One end of the third resistance R3 is electrically connected to the drain of the P-type transistor MP1. One end of the fourth resistance R4 is electrically connected to another one end of the resistance R3, and another one end of the fourth resistance R4 is electrically connected to a ground voltage GND.

A gate of the first N-type transistor MN1 receives the input voltage VIN, and a drain of the first N-type transistor MN1 receives the output voltage VOUT. The P first diodes D1~Dp is electrically connected to each other in series. A cathode and an anode of a Wth first diode DW of the first diodes are electrically connected to a anode of a (W−1)th first diode and a cathode of a (W+1)th first diode respectively, and a node of the first diode is electrically connected to a source of the first N-type transistor MN1, and a cathode of a Pth first diode DP is electrically connected to the ground voltage GND, wherein W is a positive integer between 2 to P−1.

Before proceeding following description in the embodiment, it is to be noted that the start-up voltage Sv of the current-drawing unit 240 is equal to that a sum of a turn-on voltage of the first diodes D1~DP adds a threshold voltage of the first N-type transistor MN1. When the low dropout voltage regulator 300 works in high temperature or in a fast process corner, i.e. N-type transistor and P-type transistor are high speed transistor, the start-up voltage SV decrease so as to the third current I3 is substantially equal to an amount of the current increased by the first current I1 under non-ideal situation, i.e. the third current I3 is a current which subtract the second current I2 from the first current I1.

It is worth mentioning that the designer need to design a sum of the turn-on voltage of the first diodes D1~DP, which approach a value of the predetermined output voltage VOUT. Accordingly, the low dropout voltage regulator 300 can start the first transistor MN1 with an addition of the first current I1 under the non-ideal situation synchronously.

What follows is to illustrating the operation of the low dropout voltage regulator 300 in detail.

When the input voltage VIN is a voltage within normal operation range, i.e. the input voltage VIN does not much larger than the output voltage VOUT, the P-type transistor may be turned-on without generating the leakage current. Furthermore, in this case, because the input voltage VIN is smaller than the start-up voltage SV of the current-drawing unit 240, the low dropout voltage regulator 300 does not start the first N-type transistor MN1 for generating the current channel to draw the leakage current. Therefore, after the first comparator OP1 receives the reference voltage VREF and the feedback voltage VF, the first comparator OP1 proceed the operation for comparison.

When the reference voltage VREF is larger than the feedback voltage VF, the first comparator OP1 may output the first voltage V1 moving to a low voltage level and transmit the first voltage V1 to a gate of the P-type transistor MP1 so as to turn-on the P-type transistor MP1. After the P-type transistor MP1 receives the first voltage V1 transmitted from the first comparator OP1, the P-type transistor MP1 may generate a first current I1 according to the first voltage V1 and the input voltage VIN. Next, the P-type transistor MP1 makes the received input voltage VIN step down to the output voltage VOUT and the drain of the P-type transistor MP1 output an output voltage VOUT, and then the output voltage VOUT is transmitted to one end of the third resistance R3 and the drain of the first transistor MN1.

Because the input voltage VIN is not larger than the start-up voltage SV of the current-drawing unit 240, the first N-type transistor MN1 may be closed without generating current channel to draw any current. Therefore, the first current I1 is equal to the second current I2 and the third current I3 does not be generated. Next, because the feedback unit 230 is the partial voltage circuit composed of the third resistance R3 and the fourth resistance R4, the feedback unit 130 converts the output voltage VOUT to the feedback voltage VF. Another one end of the third resistance R3 outputs the feedback voltage VF and the feedback voltage VF is transmitted to the first comparator OP1, so that the first comparator OP1 may continuously trace the state of the output voltage VOUT.

Because the first voltage V1 continuously moves to the low voltage level, the output voltage VOUT and the feedback voltage VF continuously increase until the feedback voltage VF being larger than the reference voltage VREF. Next, when the reference voltage VREF is smaller than the feedback voltage VF, the first comparator OP1 may output the first voltage V1 moving to high voltage level and transmit the first voltage V1 to the gate of the P-type transistor MP1, so that the output voltage VOUT and the feedback voltage VF revert to a predetermined value and continuously decrease until the feedback voltage VF being smaller than the reference voltage VREF. Therefore, the low dropout voltage regulator 300 may stabilize the predetermined output voltage VOUT through utilizing the negative feedback circuit composed of the first comparator OP1、P-type transistor MP1 and resistance R3、R4.

When the input voltage is a voltage outside the normal operation range of the low dropout voltage regulator 300, i.e. the input voltage VIN is much larger than the output voltage VOUT, the P-type transistor MP1 is closed. Because the P-type transistor MP1 does not totally closed, the P-type transistor MP1 may generate the first current I1 which is equal to the leakage current. Furthermore, in this case, the input voltage VIN is larger than the start-up voltage SV of the current-drawing unit 240, the low dropout voltage regulator 300 may start the first N-type transistor MN1 of the current-drawing unit 200 so as to generate the current channel to draw a portion of the leakage current, i.e. the third current I3. Accordingly, after the first comparator OP1 receives the reference voltage VREF and feedback voltage VF, the first comparator OP1 may proceed the operation for comparison.

When the reference voltage VREF is larger than the feedback voltage VF, the comparator OP1 may output the first voltage V1 moving to low voltage level and transmit the first voltage V1 to the gate of the P-type transistor MP1 so as to start the P-type transistor MP1. After the P-type transistor MP1 receives the first voltage V1 transmitted from the first comparator OP1, the P-type transistor MP1 may generate the first current I1 according to the first voltage V1 and the input voltage VIN. At the same time, the first current I1 generated by the P-type transistor MP 1 includes the leakage current. Because the first N-type transistor MN1 is turned-on for generating the current channel, the first N-type transistor MN1 may draw a portion of the leakage current, and thus the negative feedback mechanism does not be destroyed. It is worth mentioning that, in this embodiment, a sum of the turn-on voltage VD1~VDP of the first diodes D1~DP is slightly smaller than the predetermined output voltage VOUT, so the first N-type transistor is, deemed an element with resistance characteristics, is biased in the linear region.

Because the gate of the first N-type transistor is electrically connected to the input voltage VIN, the ability of drawing the third current I3 for the first N-type transistor MN1 increase with the addition of the input voltage VIN. Accordingly, the first N-type transistor MN1 is capable of drawing the increased current of the first current I1 which is flowing through the P-type transistor MP1 so as to serve as the third current I3 under the non-ideal situation. In short, at node n1, the first current I1 is the sum of the second current I2 and the third current I3 which is not equal to zero. The low dropout voltage regulator 300 may draw the third current I3, which is not equal to zero, through the current channel generated by the first N-type transistor MN1 and correspondingly elevate the ability of drawing the third current I3 with addition of the input voltage VIN. Moreover, the low dropout voltage regulator 300 may confirm the negative feedback mechanism within itself operating normally so as to stabilize the output voltage VOUT.

When low dropout voltage regulator 300 works in high temperature or in the fast process corner, the first current I1 generated by the P-type transistor MP1 may increase under the non-ideal situations. In these situations, the threshold voltage of the first N-type transistor MN1 of the current-drawing unit 240 and the turn-on voltage VD1~VDP of the first diodes D1~DP are to be decreased so as to elevate the ability of drawing the third current I3. What follows is to illustrate the relevant mechanism of the low dropout voltage regulator 300.

When the reference voltage VREF is larger than the feedback voltage VF, the first comparator OP1 may output the first voltage V1 moving to low voltage level and transmits the first voltage V1 to the gate of the P-type transistor MP1 so as to turn-on the P-type transistor MP1. After the P-type transistor MP1 receives the first voltage V1 transmitted from the first comparator OP1, the P-type transistor MP1 generates the first current I1 according to the first voltage V1 and the input voltage VIN. At the same time, the first current I1 generated by the P-type transistor MP1 increases. Because the turn-on voltages VD1~VDP of the first diodes D1~DP decrease, the gate voltage of the first N-type transistor MN1 is larger than the turn-on voltage SV so as to start the first N-type transistor MN1, wherein the gate voltage of the first N-type transistor MN1 is electrically connected to the input voltage VIN.

The first N-type transistor MN1 may generate the current channel to draw the amount of current increased by the first current I1 flowing through the P-type transistor. Similarly, at node n1, the first current I1 is the sum of the second current I2 and the third current I3 which is not equal to zero. Accordingly, the second current I2 flowing into the feedback unit 230 is still the same as the second current I2 under the ideal situation, and thus the low dropout voltage regulator 300 is able to confirm the negative feedback mechanism operating normally, so as to stabilize the predetermined output voltage VOUT.

In summary, when the input voltage VIN is the voltage outside the normal operation range of the low dropout voltage regulator 300 or works in high temperature or in the fast process corner or other non-ideal situations, the first current I1 may increase. Meanwhile, the first N-type transistor MN1 within the low dropout voltage regulator 300 may be turned-on so as to generate the current channel for drawing the amount of the current increased by the first current I1, i.e. the third current I3. Accordingly, it can be avoided that the amount of current increased by the first current I1 flowing into the feedback unit 230 so as to affect the value of the output voltage VOUT and the feedback voltage VF and destroy the negative feedback mechanism within the low dropout voltage regulator 300.

In the follow-up embodiments, the instant disclosure will describe the part which is different from aforementioned embodiment of FIG. 3, and the components same as aforementioned embodiments of FIG. 3 are thus omitted. Furthermore, similar reference numeral or mark indicate similar reference device for ease of explanation.

[Another Embodiment of the Low Dropout Voltage Regulator]

Figure 4:
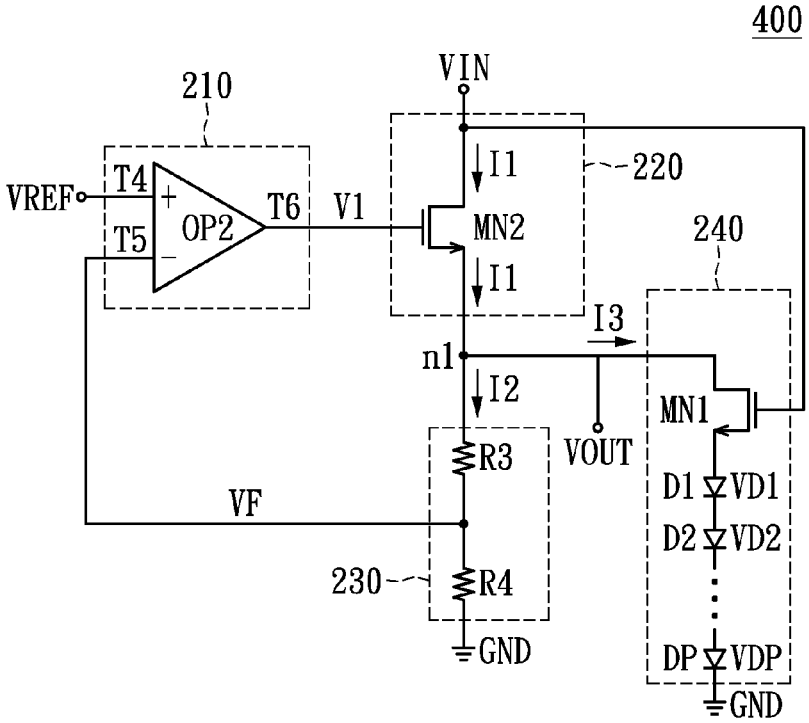
FIG. 4 shows a detailed circuit diagram of the low dropout voltage regulator according to another one embodiment of the instant disclosure.

Referring to FIG. 4, FIG. 4 shows a detailed circuit diagram of the low dropout voltage regulator according to another one embodiment of the instant disclosure. The difference from above-mentioned embodiment in FIG. 3 is that the comparison unit 210 of the low dropout voltage regulator 400 is a second comparator OP2. The buck unit 220 includes a second N-type transistor MN2. The second positive input end T4 of the comparison unit 210 receives a reference voltage VREF, the second negative input end T5 of the comparison unit 210 receives a feedback voltage VF, and the second output end T6 of the comparison unit 210 outputs a first voltage V1. A gate of the second N-type transistor MN2 is electrically connected to the second output end T6 of the comparison unit 210 so as to receive the first voltage V1, a drain of the second N-type transistor MN2 receives an input voltage VIN, and a source of the second N-type transistor MN2 outputs an output voltage and a first current I1. One end of the third resistance R3 is electrically connected to the source of the second N-type transistor MN2.

In this embodiment, the operation mechanism of the low dropout voltage regulator 400 is similar to the above-mentioned embodiment in FIG. 3. The difference is that polarity of the positive/negative input end of the first comparator OP1 is opposite to polarity of the positive/negative input end of the second comparator OP2. Accordingly, in the present embodiment, the P-type transistor MP1 needs to be replaced with the second N-type transistor MN2, so that when the reference voltage VREF is larger than the feedback voltage VF, the second comparator OP2 may output the first voltage V1 moving to high voltage level so as to turn-on the second N-type transistor MN2. In the transient process, the output voltage VOUT and the feedback voltage VF may continuously increase until the feedback voltage VF being larger than the reference voltage VREF. Therefore, when the reference voltage VREF is smaller than the feedback voltage VF, the second comparator OP2 may output the first voltage V1 moving to low voltage level so as to pull-down the output voltage VOUT and the feedback voltage VF until the feedback voltage VF being smaller than the reference voltage VREF. The low dropout voltage regulator 400 may confirm the negative feedback mechanism within itself operating normally so as to stabilize the output voltage VOUT.

The rest of the operation mechanism is the same as the above-mentioned embodiment in FIG. 3, there's no need to go into details. It is to be noted that another circuit topology of the low dropout voltage regulator 400 provided here does not limit the present disclosure. The designer or the user may do further decision according to a demand of the circuit design or real application.

[Another Embodiment of the Low Dropout Voltage Regulator]

Figure 5:
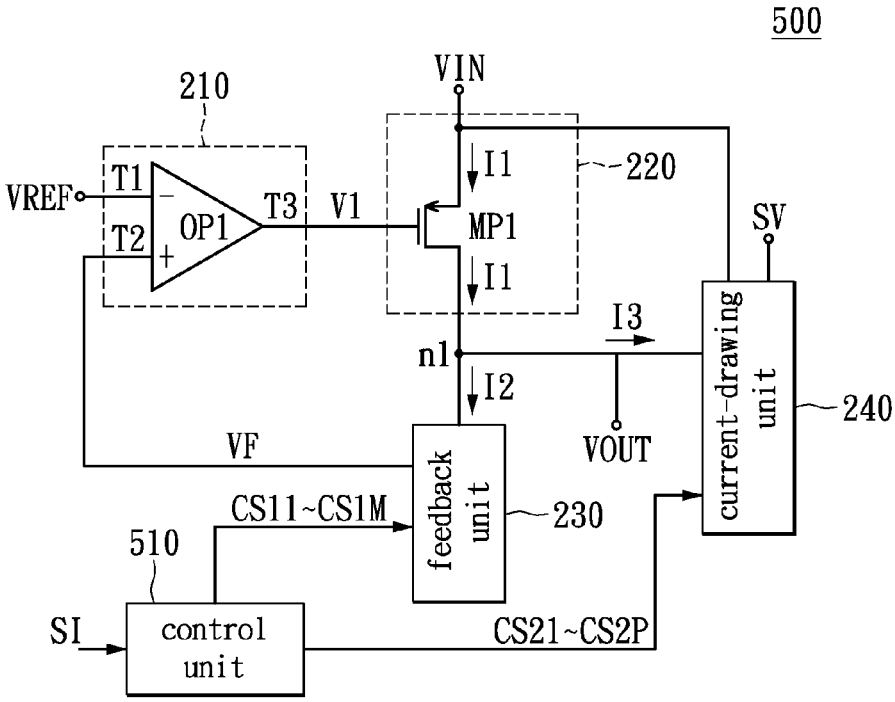
FIG. 5 and FIG. 6 show schematic diagram of the low dropout voltage regulator for adjusting the output voltage according to other embodiment of the present disclosure.
Figure 6:
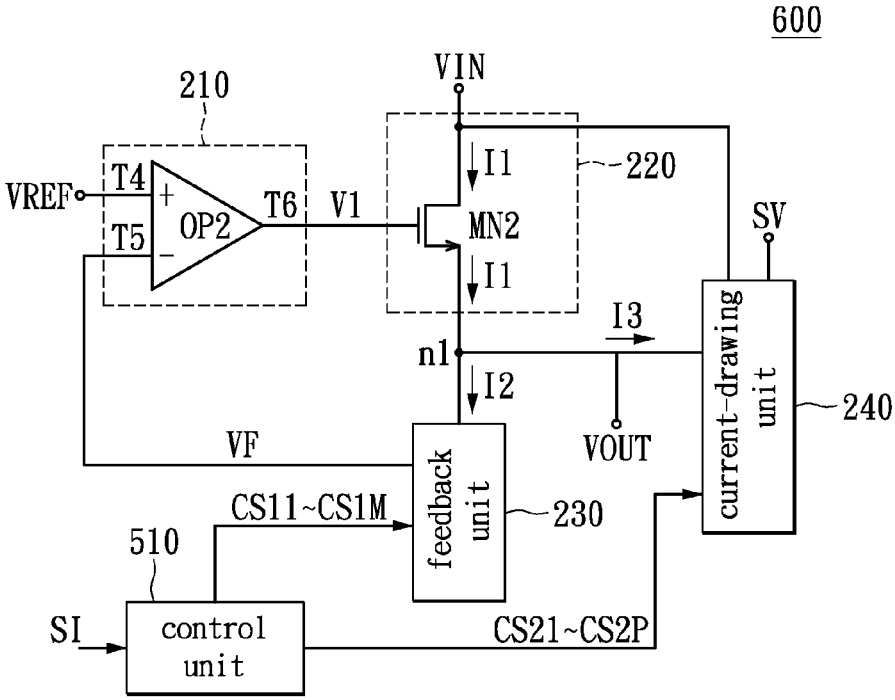

Referring to FIG. 5 and FIG. 6 at the same time, FIG. 5 and FIG. 6 show schematic diagram of the low dropout voltage regulator for adjusting the output voltage according to other embodiment of the present disclosure. Here, the embodiment in FIG. 5 is taken as an example for explanation, and a person skilled in the art can analogize to the embodiment in FIG. 6. In the embodiment, the low dropout voltage regulator 500 further includes a control unit 500. The control unit 500 is electrically connected to the feedback unit 230 and current-drawing unit 240 respectively.

The control unit 510 is used for receiving a output voltage adjusting command SI and transmits a plurality of first control signals CS11~CS1M and a plurality of second control signals CS21~CS2P to the feedback unit 230 and the current-drawing unit 240 respectively so as to adjust the output voltage VOUT and the start-up voltage SV.

In this embodiment, the user or the designer may input a value of a predetermined output voltage VOUT, which is within normal range, through an input interface (not shown in FIG. 5). Meanwhile, the input interface may transform the received value to the corresponding output voltage adjusting command SI and transmits the output voltage adjusting command SI to the control unit 150. Next, the control unit 510 may concurrently transmit the plurality of first control signals CS11~CS1M and the plurality of second control signals CS21~CS2P to the feedback unit 230 and the current-drawing unit 240 respectively according to the output voltage adjusting command SI. Incidentally, in another one embodiment, the system of the electronic device automatically adjusts the output voltage VOUT of the low dropout voltage regulator 500 according to the voltage demand of the other circuit stage and transmits the output voltage adjusting command to the control unit 510.

If the user wants to elevate a value of the output voltage, the feedback unit 230 receives the plurality of first control signals CS11~CS1M, and then the feedback unit 230 elevates the output voltage VOUT until the value which is inputted by the user. After the current-drawing unit 240 receives the plurality of second control signals CS21~CS2P, the current-drawing unit 240 may elevate the start-up voltage SV synchronously. If the user wants to reduce a value of the output voltage VOUT, the feedback unit 230 receives a plurality of first control signals CS11~CS1M, and then the feedback unit 230 may lower the output voltage VOUT until the value which is inputted by the user. After the current-drawing unit 240 receives the plurality of second control signals CS21~CS2P, the current-drawing unit 240 may lower the start-up voltage SV synchronously.

Accordingly, the embodiment of the present disclosure may cause that the difference of the start-up voltage SV and the output voltage VOUT is the value which is designed initially, so that when the first current I1 generated from the P-type transistor MP1 increase under non-ideal situation, the low dropout voltage regulator 500 may start the current-drawing channel so as to generate the current channel for drawing the third current I3 in time. Therefore, the low dropout voltage regulator 500 is capable of stabilizing the predetermined output voltage VOUT.

For teaching the operation of the low dropout voltage regulator for adjusting the output voltage in detail, what follows is to illustrate for explanation with another diagram.

[The Embodiment of the Low Dropout Voltage Regulator for Adjusting the Output Voltage]

Figure 7:
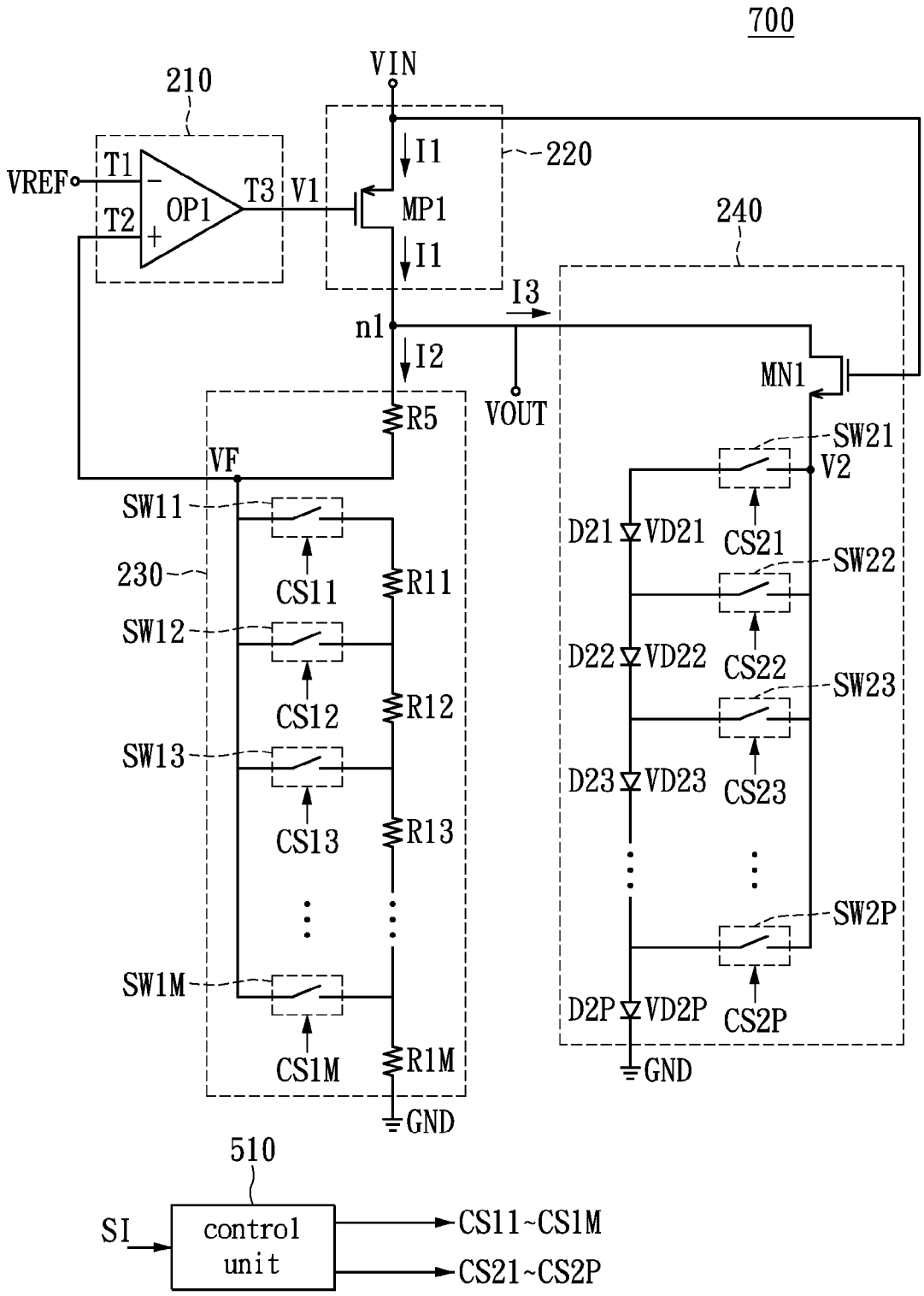
FIG. 7 shows a detailed circuit diagram of the low dropout voltage regulator for adjusting the output voltage corresponding to FIG. 5.
Figure 8:
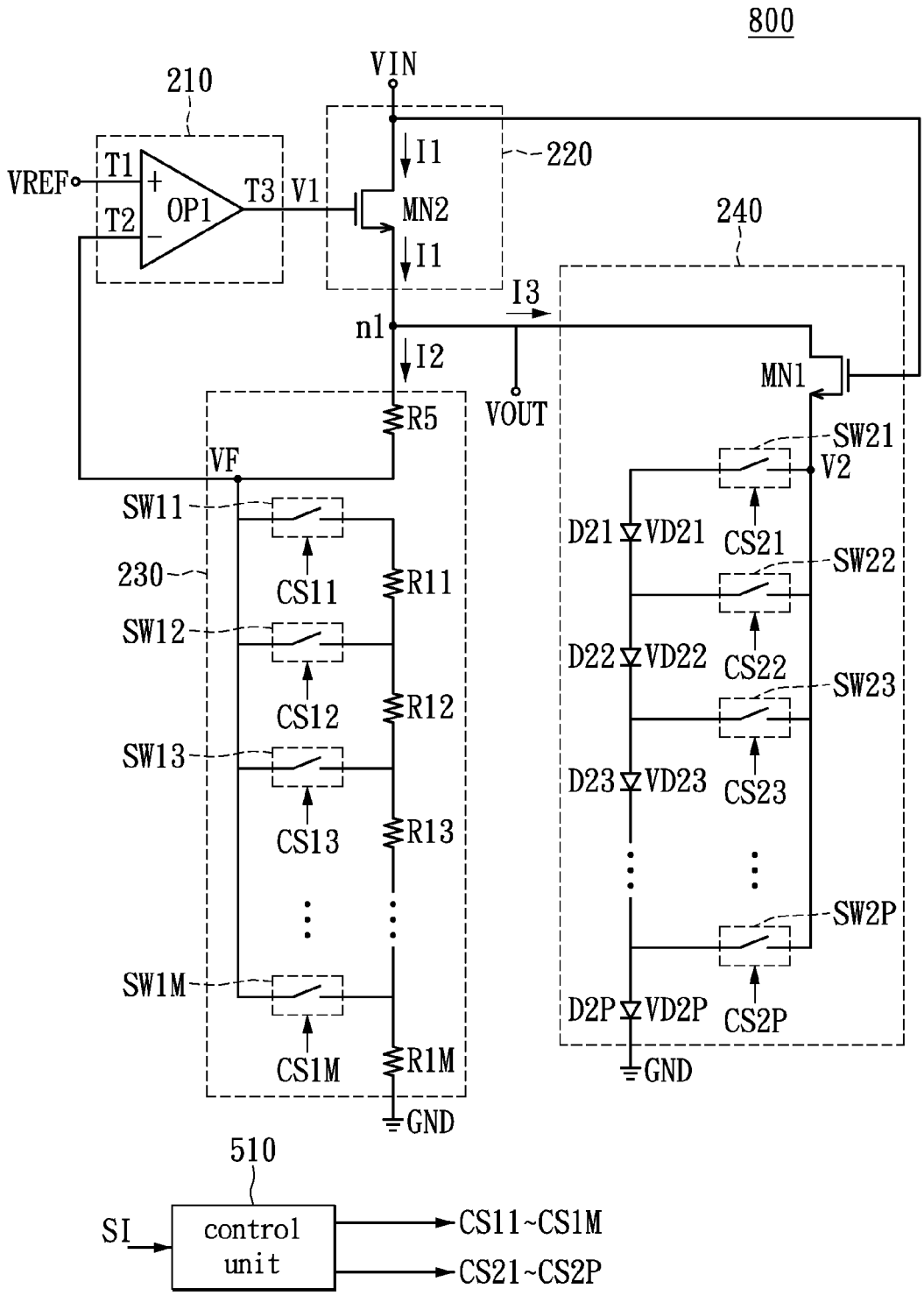
FIG. 8 shows a detailed circuit diagram of the low dropout voltage regulator for adjusting the output voltage corresponding to FIG. 6.

Referring to FIG. 7 and FIG. 8, FIG. 7 shows a detailed circuit diagram of the low dropout voltage regulator for adjusting the output voltage corresponding to FIG. 5. FIG. 8 shows a detailed circuit diagram of the low dropout voltage regulator for adjusting the output voltage corresponding to FIG. 6. Here, the embodiment in FIG. 7 is taken as an example for explanation, and a person skilled in the art can analogize to the embodiment in FIG. 8.

Please referring to FIG. 7, the difference from the embodiment in FIG. 5 is that the feedback unit 230 of the low dropout voltage regulator 700 includes a fifth resistance R5, M impedance elements R11~R1M and M first switches SW11~SW1M, wherein M is a positive integer. The current-drawing unit 240 includes P second diodes D21~D2P and P second switches SW21~SW2P, wherein P is a positive integer. One end of the fifth resistance R5 is electrically connected to a drain of the P-type transistor MP1. In the embodiment of FIG. 8, one end of the fifth resistance R5 is electrically to a source of the second N-type transistor MN2.

The impedance elements R11~R1M are electrically connected to each other in series, wherein another one end of the Mth impedance element R1M is electrically connected to the ground voltage GND. One end of the switches SW11~SW1M are electrically connected to another one end of the fifth resistance R5, and another one end of the Xth switch SWX of the switches SW11~SW1M is electrically connected between (X−1)th impedance element and Xth impedance element. Another one end of the first switch SW11 is electrically connected to one end of the first impedance element R11. Incidentally, the impedance elements R11~R1M may be a resistance or a transistor operating in the linear region.

The second diodes D21~D2P are electrically connected to each other in series. An anode and a cathode of the Yth second diode D2Y of the second diodes D21~D2P are electrically connected to a cathode of the (Y−1)th second diode and a cathode of the (Y+1)th second diode respectively. An anode of the first second diode D21 is electrically connected to a source of the first N-type transistor MN1, and a cathode of the Pth second diode D2P is electrically connected to the ground voltage GND, wherein Y is a positive integer between 2 to P−1.

One end of the second switches SW21~SW2P are electrically connected to a source of the second N-type transistor MN2, another one end of Zth switch SE2Z of the second switches SW21~SW2P is electrically connected between (Y−1)th second diode and Yth second diode, and another one end of first switch SW21 is electrically connected to an anode of the first second diode D21, wherein Z is a positive integer between 2 to P.

One end of the fifth resistance R5 is used for receiving the output voltage VOUT, and another one end of the fifth resistance R5 is used for outputting the feedback voltage VF. The switches SW11~SW1M are used for receiving the plurality of first control signals CS11~CS1M and the switches SW11~SW1M determine a turn-on or turn-off state according to the plurality of first control signals so as to adjust the feedback voltage VF, and then to adjust the output voltage VOUT. The second switches SW21~SW2P are used for receiving the plurality of second control signals CS21~CS2P and the second switches SW21~SW2P determine a turn-on or turn-off state according to the plurality of second control signals CS21~CS2P so as to adjust the second voltage V2, and then to adjust the start-up voltage SV.

What follows is to further illustrate detailed operation of the low dropout voltage regulator for adjusting the output voltage.

In this embodiment, the user or system may adjust a value of the output voltage properly. After the control unit 510 receives the output voltage adjusting command SI, the control unit 510 may output the plurality of first control signals CS11~CS1M to the switch SW11~SW1M so as to control a turn-on or turn-off state according to the output voltage adjusting command SI, and then properly adjust the relationship of electrically connection among the impedance elements R11~R1M. In other words, the control unit 510 changes the relationship of IR drop so as to adjust the feedback voltage VF. Because the partial voltage circuit is composed of the fifth resistance R2 and the impedance element R11~R1M, i.e. the feedback voltage VF is a partial voltage of the output voltage VOUT, the feedback voltage VF and the output voltage VOUT are adjusted synchronously.

It is to be noted that in the case of the output voltage VOUT being adjusted until a predetermined value, if lowering the output voltage VOUT, it is probably to make the output voltage VOUT lower than the second voltage V2, so that when the first current I1 increases under non-ideal situation, the low dropout voltage regulator 700 may start the first N-type transistor MN1 so as to generate the current channel, wherein the input voltage VIN is larger than the sum of the second voltage V2 and the threshold voltage of the N-type transistor MN1. However, because the output voltage VOUT is lower than the second voltage V2, the N-type transistor MN1 can not draw the third current I3, and thus it is probably to destroy negative feedback mechanism of the low dropout voltage regulator.

In the other hand, if elevating the output voltage VOUT as the first current I1 increases under non-ideal situation, the low dropout voltage regulator 700 may start the first N-type transistor MN1 so as to generate current channel. However, because the voltage between the output voltage VOUT and the second voltage V2 is too large, the first N-type transistor MN1 draws the excessive third current I3, i.e. the drawn third current I3 excesses the amount of current increased from the first current I1, so that it is probably to destroy negative feedback mechanism of the low dropout voltage regulator 700. Additionally, because the voltage between the output voltage VOUT and the second voltage V2 is too large, the first N-type transistor MN1 may enter into saturate region, i.e. nonlinear region, and then the first N-type transistor MN1 can not precisely draw the amount of current increased from the first current I1 under non-ideal situation, so that it is probably to destroy negative feedback mechanism of the low dropout voltage regulator 700.

Therefore, in this embodiment, when the control unit 510 transmits the plurality of first control signals CS11~CS1M to the switches SW11~SW1M, the control unit 510 also concurrently transmits the plurality of second control signals CS21~CS2P to the switches SW21~SW2P. When the output voltage elevates, the second voltage is also elevated concurrently so that the voltage between the output voltage VOUT and the second voltage V2 maintains a predetermined initial value. Accordingly, when the first N-type transistor MN1 starts, the first N-type transistor MN1 may operate in the linear region.

For example, suppose M and P are equal to five, when the control unit 510 transmits the plurality of first control signals CS11~CS15, such as digital logic signal 00100, to corresponding switches SW11~SW15, the switch SW13 may turn-on and the other switches (e.g. SW11, SW12, SW14 and SW15) turn-off, and thus the second current I2 may flow through the impedance elements R13~R15. Moreover, the control unit 510 may also correspondingly transmits the plurality of second control signals CS21~CS25, such as digital logic signal 00100, to the second switches SW21~SW25, the switch SW23 may turn-on and the other switches (e.g. SW21, SW22, SW24 and SW25) turn-off, and thus the value of the second voltage V2 is the sum of the turn-on voltage VD23~VD25 of the second diodes.

When the control unit 510 receives the output voltage adjusting command SI for elevating the output voltage VOUT, the control unit 510 transmits the plurality of first control signals CS11~CS15, such as digital logic signal 10000, to corresponding first switches SW11~SW15, and then the switch SW1 may turn-on and the other switches (e.g. SW12, SW13, SW14 and SW15) turn-off, and thus the second current I2 flows through the impedance element R11~R15 so as to elevate the output voltage VOUT. The control unit 510 may also transmits the plurality of second control signals CS21~CS2P, such as digital logic signal 10000, to the switches SW21~SW25, and then the switch 21 may turn-on and the other switches (e.g. SW22, SW23, SW24 and SW25) turn-off. Accordingly, the value of the second voltage V2 increases until the second voltage V2 being equal to the sum of the turn-on voltage VD21~VD25 of the second diodes.

Similarly, after the control unit 510 receives the output voltage adjusting command SI for lowering the output voltage VOUT, the control unit 510 transmits the plurality of first control signals CS11~CS15, such as digital logic signal 00001, to the corresponding switches SW11~SW15, and then the switch SW15 may turn-on and the other switches (e.g. SW11, SW12, SW13 and SW14) turn-off. Accordingly, the second current I2 may flow through impedance element R15 so as to lower the output voltage VOUT. The control unit 510 may also concurrently transmits the plurality of second control signals CS21~CS25, such as digital logic signal 00001, to the second switches SW21~SW25, and then the switch SW25 may turn-on and the other switches (e.g. SW21, SW22, SW23 and SW24) turn-off. Accordingly, the value of the second voltage V2 may decrease until the second voltage V2 being equal to the turn-on voltage of the second diode D25.

Therefore, the voltage between the output voltage VOUT and the second voltage V2 may maintain a predetermined initial value, so that when the first N-type transistor MN1 is started, the first N-type transistor MN1 may be biased in the linear region. Next, the first N-type transistor MN1 may draw the amount of current increased from the first current I1 under non-ideal situation, and the amount of current may be served as the third current I3, an thus the low dropout voltage regulator 700 still may concurrently maintain negative feedback mechanism as adjusting the output voltage VOUT.

[Embodiment of the Electronic Device]

Figure 9:
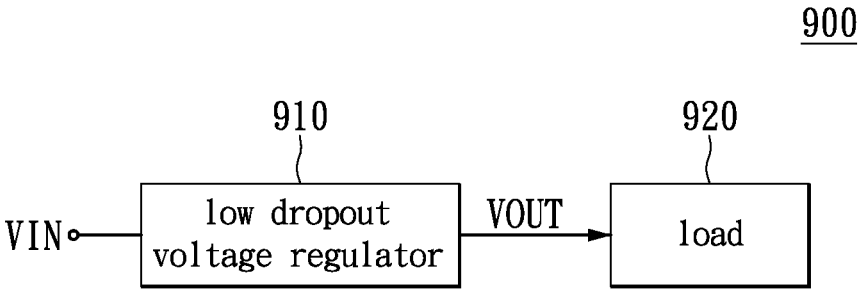
FIG. 9 shows a schematic diagram of the electronic device with the low dropout voltage regulator according to one embodiment of the present disclosure.

Referring to FIG. 9, FIG. 9 shows a schematic diagram of the electronic device with the low dropout voltage regulator according to one embodiment of the present disclosure. Electronic device 900 includes a load 920 and the low dropout voltage regulator 910 electrically connected to the load 920, the low dropout voltage regulator 910 receives the input voltage VIN. The input voltage VIN may be a system voltage used by general electronic device. The low dropout voltage regulator 910 may be one of the aforementioned low dropout voltage regulator 200、300、400、500、600 and 700 in the embodiment of FIG. 2~FIG. 8 and the low dropout voltage regulator 910 is used for providing the stable voltage VOUT to the load. The electronic device 900 may be any kind of electronic, such as handheld device or mobile device.

To sum up, the low dropout voltage regulator and the electronic device provided by present disclosure may ensure the normal operation of the negative feedback mechanism within the low dropout voltage regulator so as to stabilize the predetermined output voltage.

In at least one of the embodiments of the instant disclosure, when the control unit adjusts the output voltage, the voltage between the output voltage and the second voltage maintain the predetermined initial value, so that when the first N-type transistor starts, the first N-type transistor may be biased in the linear region and the first N-type transistor may draw the amount of current increased from first current under non-ideal situations. Accordingly, the low dropout voltage regulator is concurrently capable of maintaining the negative feedback mechanism as the low dropout voltage regulator adjusts the output voltage.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims

What is claimed is:

1. A low dropout voltage regulator, comprising:

a comparison unit, receiving a reference voltage and a feedback voltage, outputting a first voltage, and comparing the reference voltage and the feedback voltage to output a first voltage;

a buck unit, electrically connected to the comparison unit, the buck unit receiving an input voltage and the first voltage and having the input voltage stepping down to an output voltage, wherein the buck unit outputs a first current according to the first voltage and the output voltage;

a feedback unit, electrically connected between the buck unit and the comparison unit, the feedback unit receiving the output voltage, and after converting the output voltage to the feedback voltage, the feedback unit transmitting the feedback voltage to the comparison unit; and a current-drawing unit, receiving the input voltage and output voltage;

wherein when the input voltage is smaller than a start-up voltage, the current-drawing unit turns off and a second current flowing through the feedback unit is equal to the first current substantially, wherein when the output voltage is larger than the start-up voltage, the current-drawing unit draws a third current and the third current is equal to a sum of the first current and the second current.

2. The low dropout voltage regulator according to claim 1, wherein the first current generating from the buck unit increases under at least one non-ideal situation, the current-drawing unit draws amount of the current increased by the first current correspondingly.

3. The low dropout voltage regulator according to claim 1, wherein the comparison unit is a first comparator, a first positive input end of the first comparator receives the feedback voltage, a first negative input end of the first comparator receives the reference voltage, and a first output end of the first comparator outputs the first voltage, wherein the buck circuit comprises a P-type transistor, a gate of the P-type transistor receives the first voltage, a source of the P-type transistor receives the input voltage, and a drain of the P-type transistor outputs the output voltage and the first current.

4. The low dropout voltage regulator according to claim 3, wherein the feedback unit comprises:

a first resistance, one end of the first resistance electrically connected to the buck unit and receiving the input voltage, and another one end of the first resistance outputting the feedback voltage; and a second resistance, one end of the second resistance electrically connected to another one end of the first resistance, and the another one end of the second resistance electrically connected to a ground voltage, wherein the feedback voltage is a partial voltage of the output voltage.

5. The low dropout voltage regulator according to claim 4, wherein the current-drawing unit comprises:

a first N-type transistor, a gate of the first N-type transistor receiving the input voltage, and a drain of the first N-type transistor receiving the output voltage; and P first diodes, electrically connected to each other in series, a cathode and an anode of a Wth first diode of the first diodes electrically connected to a anode of a (W−1)th first diode and a cathode of a (W+1)th first diode respectively, a node of the first diode electrically connected to a source of the first N-type transistor, and a cathode of a Pth first diode electrically connected to the ground voltage, Wherein P is a positive integer, and W is a positive integer between 2 to P−1.

6. The low dropout voltage regulator according to claim 5, wherein the start-up voltage is equal to that a sum of a turn-on voltage of the first diodes adds a threshold voltage of the first N-type transistor, and when the low dropout voltage regulator works in high temperature or in a fast process corner, the start-up voltage decrease so as to the third current is substantially equal to an amount of the current increased by the first current.

7. The low dropout voltage regulator according to claim 3, further comprising:

a control unit, electrically connected to the feedback unit and the current-drawing unit, the control unit receiving a output voltage adjusting command and transmitting a plurality of first control signals and a plurality of second control signals to the feedback unit and the current-drawing unit respectively according to the output voltage adjusting command, so as to adjust the output voltage and the start-up voltage simultaneously.

8. The low dropout voltage regulator according to claim 7, wherein the feedback unit comprises:

a third resistance, one end of the third resistance electrically connected to a drain of the P-type transistor or a source of the second N-type transistor and receiving the output voltage, and another one end of the third resistance outputting the feedback voltage;

M impedance elements, electrically connected to each other in series, wherein another one end of a Mth impedance element electrically connected to the ground voltage; and M first switches, one end of the M first switches electrically connected to another one end of the third resistance, another one end of a Xth switch of the first switches electrically connected between a (X−1)th impedance element and a Xth impedance element, another one end of a first switch electrically connected to one end of a first impedance element, and the first switches receiving the plurality of first control signals to determine a turn-on state or a turn-off state itself, so as to adjust the feedback voltage and the output voltage according to the plurality of first control signals, wherein M is a positive integer, and X is a positive integer between 2 to M.

9. The low dropout voltage regulator according to claim 8, wherein the current-drawing unit comprises:

P second diodes, electrically connected to each other in series, a anode and a cathode of a Yth second diode of the second diodes electrically connected to a cathode of a (Y−1) second diode and a anode of (Y+1) second diode respectively, a anode of a first second diode electrically connected to a source of a first N-type transistor, and a cathode of a Pth second transistor electrically connected to the ground voltage, wherein Y is a positive integer between 2 to (P−1); and P second switches, one end of the second diodes electrically connected to a source of the second N-type transistor, another one end of a Zth switch of the second switches electrically connected between a (Y−1)th second diode and a Yth diode, another one end of a first switch electrically connected to a anode of a first second diode, and the second switches receiving the plurality of second control signals to determine a turn-on state or turn-off state, so as to adjust a second voltage and the start-up voltage according to the plurality of second control signals, wherein P is a positive integer, and Z is a positive integer between 2 to P.

10. The low dropout voltage regulator according to claim 9, wherein the start-up voltage is equal to that a sum of a turn-on voltage of the second diodes adds a threshold voltage of the first N-type transistor, and when the low drop-out voltage regulator works in high temperature or in the fast process corner, the start-up voltage decreases, so that the third current is substantially equal to a amount of current increased by the first current.

11. The low dropout voltage regulator according to claim 1, wherein the comparison circuit is a second comparator, a second positive input end of the second comparator receives the reference voltage, a second negative input end of the second comparator receives the feedback voltage, and a second output end of the second comparator outputs the first voltage, wherein the buck unit comprises a second N-type transistor, a gate of the second N-type transistor receives the first voltage, a drain of the second N-type transistor receives the input voltage, and a source of the second N-type transistor outputs the output voltage and the first current.

12. The low dropout voltage regulator according to claim 11, wherein the feedback unit comprises:

a first resistance, one end of the first resistance electrically connected to the buck circuit and receiving the output voltage, and another one end of the first resistance outputting the feedback voltage; and a second resistance, one end of the second resistance electrically connected to another one end of the first resistance, and another one end of the second resistance electrically connected to a ground voltage, wherein the feedback voltage is a partial voltage of the output voltage.

13. The low dropout voltage regulator according to claim 12, wherein the current drawing unit comprises:

a first N-type transistor, a gate of the first N-type transistor receiving the input voltage, and a drain of the first N-type transistor receiving the output voltage; and P first diodes, electrically connected to each other in series, a cathode and a anode of a Wth first diode of the first diodes electrically connected to a anode of a (W−1)th first diode and a cathode of a (W+1)th first diode respectively, a node of the first diode electrically connected to a source of the first N-type transistor, and a cathode of a Pth first diode electrically connected to the ground voltage, wherein P is a positive integer, and W is a positive integer between 2 to P−1.

14. The low dropout voltage regulator according to claim 13, wherein the start-up voltage is equal to that a sum of a turn-on voltage of the first diodes adds a threshold voltage of the first N-type transistor, and when the low dropout voltage regulator works in high temperature or in a fast process corner, the start-up voltage decrease so as to the third current is substantially equal to a amount of the current increased by the first current.

15. The low dropout voltage regulator according to claim 11, further comprising:

a control unit, electrically connected to the feedback unit and the current-drawing unit, the control unit receiving a output voltage adjusting command and transmitting a plurality of first control signals and a plurality of second control signals to the feedback unit and the current-drawing unit respectively according to the output voltage adjusting command, so as to adjust the output voltage and the start-up voltage simultaneously.

16. The low dropout voltage regulator according to claim 15, wherein the feedback unit comprises:

a third resistance, one end of the third resistance electrically connected to a drain of the P-type transistor or a source of the second N-type transistor and receiving the output voltage, and another one end of the third resistance outputting the feedback voltage;

M impedance elements, electrically connected to each other in series, wherein another one end of a Mth impedance element electrically connected to the ground voltage; and M first switches, one end of the M first switches electrically connected to another one end of the third resistance, another one end of a Xth switch of the first switches electrically connected between a (X−1)th impedance element and a Xth impedance element, another one end of a first switch electrically connected to one end of a first impedance element, and the first switches receiving the plurality of first control signals to determine a turn-on state or a turn-off state itself, so as to adjust the feedback voltage and the output voltage according to the plurality of first control signals, wherein M is a positive integer, and X is a positive integer between 2 to M.

17. The low dropout voltage regulator according to claim 16, wherein the current-drawing unit comprises:

P second diodes, electrically connected to each other in series, a anode and a cathode of a Yth second diode of the second diodes electrically connected to a cathode of a (Y−1) second diode and a anode of (Y+1) second diode respectively, a anode of a first second diode electrically connected to a source of a first N-type transistor, and a cathode of a Pth second transistor electrically connected to the ground voltage, wherein Y is a positive integer between 2 to (P−1); and P second switches, one end of the second diodes electrically connected to a source of the second N-type transistor, another one end of a Zth switch of the second switches electrically connected between a (Y−1)th second diode and a Yth diode, another one end of a first switch electrically connected to a anode of a first second diode, and the second switches receiving the plurality of second control signals to determine a turn-on state or turn-off state, so as to adjust a second voltage and the start-up voltage according to the plurality of second control signals, wherein P is a positive integer, and Z is a positive integer between 2 to P.

18. The low dropout voltage regulator according to claim 17, wherein the start-up voltage is equal to that a sum of a turn-on voltage of the second diodes adds a threshold voltage of the first N-type transistor, and when the low drop-out voltage regulator works in high temperature or in the fast process corner, the start-up voltage decreases, so that the third current is substantially equal to a amount of current increased by the first current.

19. A electronic device, comprising:

the low dropout voltage regulator according to claim 1, receiving the input voltage and having an input voltage stepping down to an output voltage; and a load, receiving the output voltage.

* * * * *